US006231271B1

(12) United States Patent
Glass et al.

(10) Patent No.: US 6,231,271 B1
(45) Date of Patent: May 15, 2001

(54) APPARATUS AND METHOD FOR LIFTING PILES

(75) Inventors: James O. Glass; Sam M. Glass, both of Anahuac, TX (US)

(73) Assignee: Stab Cat, Inc, Anahuac, TX (US)

( * ) Notice: Subject to any disclaimer, the term of this patent is extended or adjusted under 35 U.S.C. 154(b) by 0 days.

(21) Appl. No.: 09/286,169

(22) Filed: Apr. 5, 1999

(51) Int. Cl.[7] ..... E02D 7/26
(52) U.S. Cl. ..... 405/274; 405/279
(58) Field of Search ..... 405/274, 50, 230, 405/232, 243, 275, 276, 277, 278, 279, 280, 281; 294/102.1, 114, 86.4, 82.24, 67.22; 175/171

(56) References Cited

U.S. PATENT DOCUMENTS 3,638,909 * 2/1972 Dew ..... 294/82.24
3,926,468 * 12/1975 Kondo ..... 294/86.4
4,427,228 * 1/1984 Mattila ..... 294/102.1
4,709,764 * 12/1987 Gibbons ..... 173/45
5,407,304 4/1995 Glass et al. .
5,503,503 4/1996 Glass et al. .
5,618,135 4/1997 Glass et al. .
5,803,672 9/1998 Glass et al. .

* cited by examiner

*Primary Examiner*—Robert E. Pezzuto
(74) *Attorney, Agent, or Firm*—Browning Bushman P.C.

(57) ABSTRACT

A lifting apparatus for non-metallic piles (10) including a pair of lifting devices (26, 28) which grip opposed faces (22, 24) of the pile (10). A sling (36) supported from an overhead crane (44) is connected to the lifting arms or handles (30) of the lifting devices (26, 28) for lifting of the pile (10). The lifting handles (30) are secured to cams 72 which include gripping teeth (76) effective upon lifting of handles (30) to engage the inner face (24) of pile (10) for gripping the pile (10) between backing edge (58) and inner face (24). A modification shown in FIGS. 5 and 6 provides a threaded screw (86A) which is received within an opening (89A) in the pile (10) for lifting of the pile (10).

5 Claims, 4 Drawing Sheets

APPARATUS AND METHOD FOR LIFTING PILES

FIELD OF THE INVENTION

This invention relates to an apparatus and method for lifting sheet piles, and more particularly to such an apparatus and method which includes gripping of opposed surfaces of the sheet pile for lifting of the sheet pile.

BACKGROUND OF THE INVENTION

As well known, sheet metal piles are driven by a pile driver at a construction site into the ground or the bottom of a body of water, such as a stream or bay, for example. The sheet metal piles normally are of a channel or Z-shape in cross section and adjacent piles have interlocked side edges to prevent separation of the driven piles thereby to provide a continuous wall. Adjacent side edges of adjacent piles interfit in an interlocking relation and an undriven pile is raised and vertically aligned with an adjacent driven pile for subsequent threading or stabbing of the side edges upon lowering of the undriven pile thereby forming the interlocking relation. Sheet piles when handled for being driven in an earth formation, particularly if the pile is formed of a non-metallic material or a relatively thin metal material such as aluminum, may become damaged from lifting or driving into the ground. Sheet piles or piling for certain uses such as sea walls, for example, may be formed of interlocking piling extruded from special vinyl formulations. Sheet piles formed of a rigid vinyl material are resistant to marine bores, rot, rust, galvanic corrosion, or highly acidic or alkaline soil conditions.

For interfitting or threading the lower end of an undriven pile onto the vertically aligned upper end of the driven pile, the undriven pile must be lifted to a height above the upper end of the driven pile for threading of the interfitting edges of the driven pile and the undriven pile. A pile threading device is normally utilized for accurate threading of the interfitting edges at the upper end of the driven pile and the pile threading device may be lifted by the undriven pile to the upper end of the driven pile for threading of the piles. After the lower end of the undriven pile clears the upper end of the driven pile, a workman at ground level actuates a laterally movable slide on the pile threading device to move the upper undriven pile laterally into a vertically aligned position with the subjacent side edge of the driven pile for threading the side edge of the undriven pile onto the side edge of the fixed driven pile. The accurate positioning and alignment of the side edges of the adjacent sheet piles for threading or stabbing eliminates the necessity of a workman being present adjacent the upper end of the driven pile thereby avoiding a possible safety hazard. It is important that the sheet piles be accurately aligned for registering of the interfitting side edges for threading so that a workman at a ground location below the raised undriven pile can easily move the undriven pile into accurate vertical alignment with the adjacent side edge of the driven pile.

The undriven pile is normally raised by an overhead crane of the like relative to the fixed driven pile until the lower end of the undriven pile clears the upper end of the driven pile. A threading device such as shown in U.S. Pat. No. 5,618,135 dated Apr. 8, 1997 may be lifted by the undriven pile for accurately threading the side edges of the driven pile and undriven pile. For lifting of the undriven pile, an opening is provided in the pile along its upper edge and a hook from an overhead crane is received within the opening for lifting the undriven pile to a position above the upper end of the adjacent driven pile. When the sheet piles are formed of a non-metallic material, failure of the non-metallic material adjacent the opening may occur especially if the piles are of a relatively large weight and if the threading device are lifted by the undriven piles.

It is an object of the present device to provide an apparatus and method for lifting a sheet pile, particularly a non-metallic sheet pile, in a gripping action applied against opposed faces of the sheet pile.

SUMMARY OF THE INVENTION

The present invention is directed to an apparatus and method for lifting a sheet pile which grips opposed faces of the sheet pile adjacent a side edge thereof with the gripping force increasing with the weight of the sheet pile. The apparatus comprises a lifting device having a receptacle to receive a marginal edge portion of a sheet pile and a gripping member mounted for rotation about an eccentric axis. The gripping member has a handle for exerting a rotative movement to the eccentric gripping member. The handle is connected to an overhead lifting means such as a crane and a rotative movement is applied to the eccentric gripping memberfor tightly gripping of opposed faces of the sheet pile for lifting of the sheet pile. The gripping member has teeth along an arcuate surface thereof for biting into an adjacent face of the sheet pile.

The lifting apparatus includes a pair of lifting devices for mounting on opposite faces of the sheet pile. Each of the lifting devices has a handle and a suitable sling suspended from an overhead crane is connected to the handle of the lifting devices for lifting of the lifting devices and the sheet pile connected thereto. The lifting devices preferably include the cam which is effective for gripping of opposed faces of the sheet pile by the lifting device with the gripping force increasing with an increase in the lifted force. The camming action against the face of the pile does not provide any harmful action against the pile. The present invention is particularly adapted for non-metallic sheet piles such as sheet piles formed of a vinyl material.

Other objects, features, and advantages of the invention will be apparent from the following specification and drawings.

DESCRIPTION OF THE INVENTION

Figure 1:
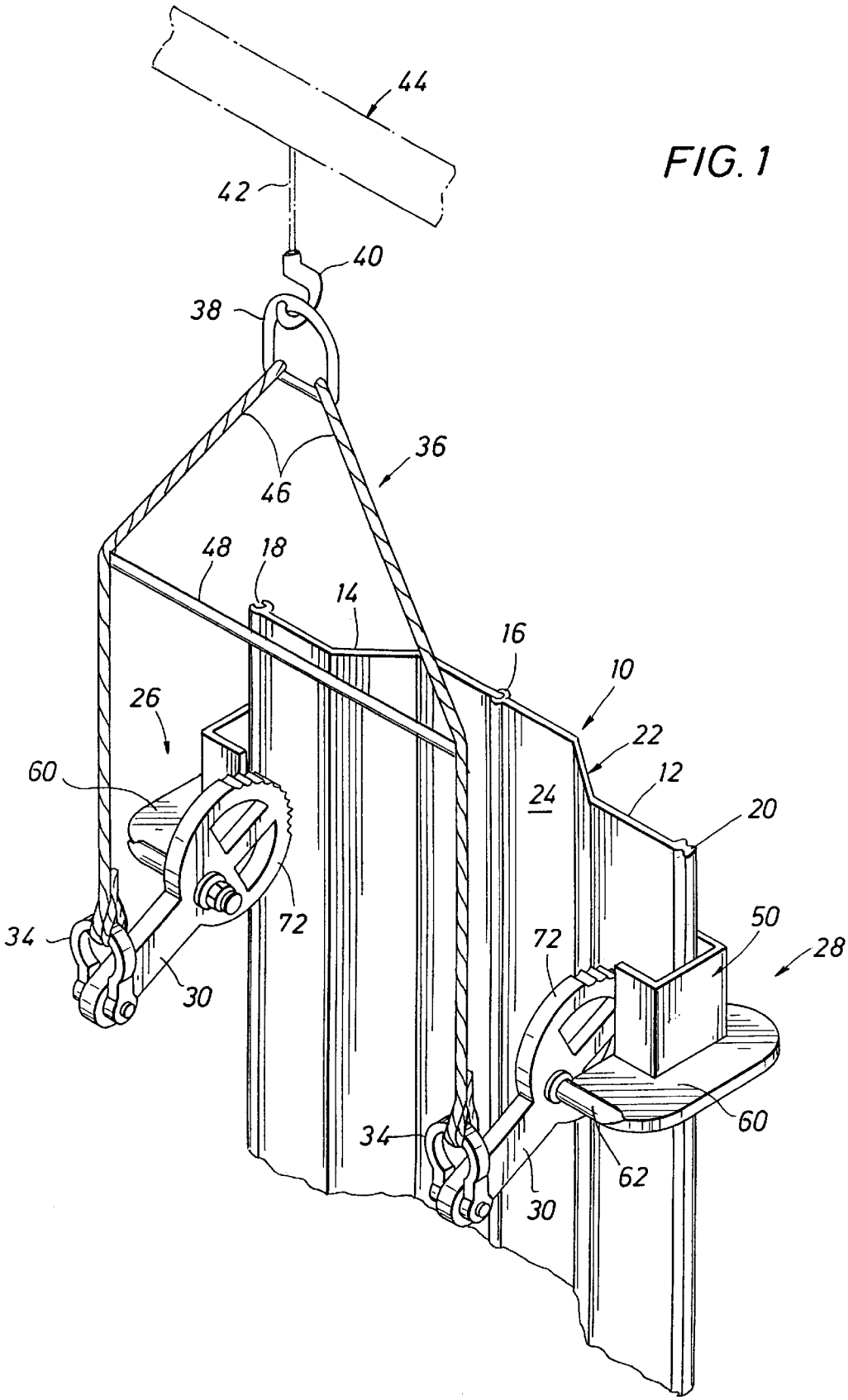
FIG. 1 is a perspective of the lifting apparatus of the present invention for lifting an undriven sheet pile.
Figure 2:
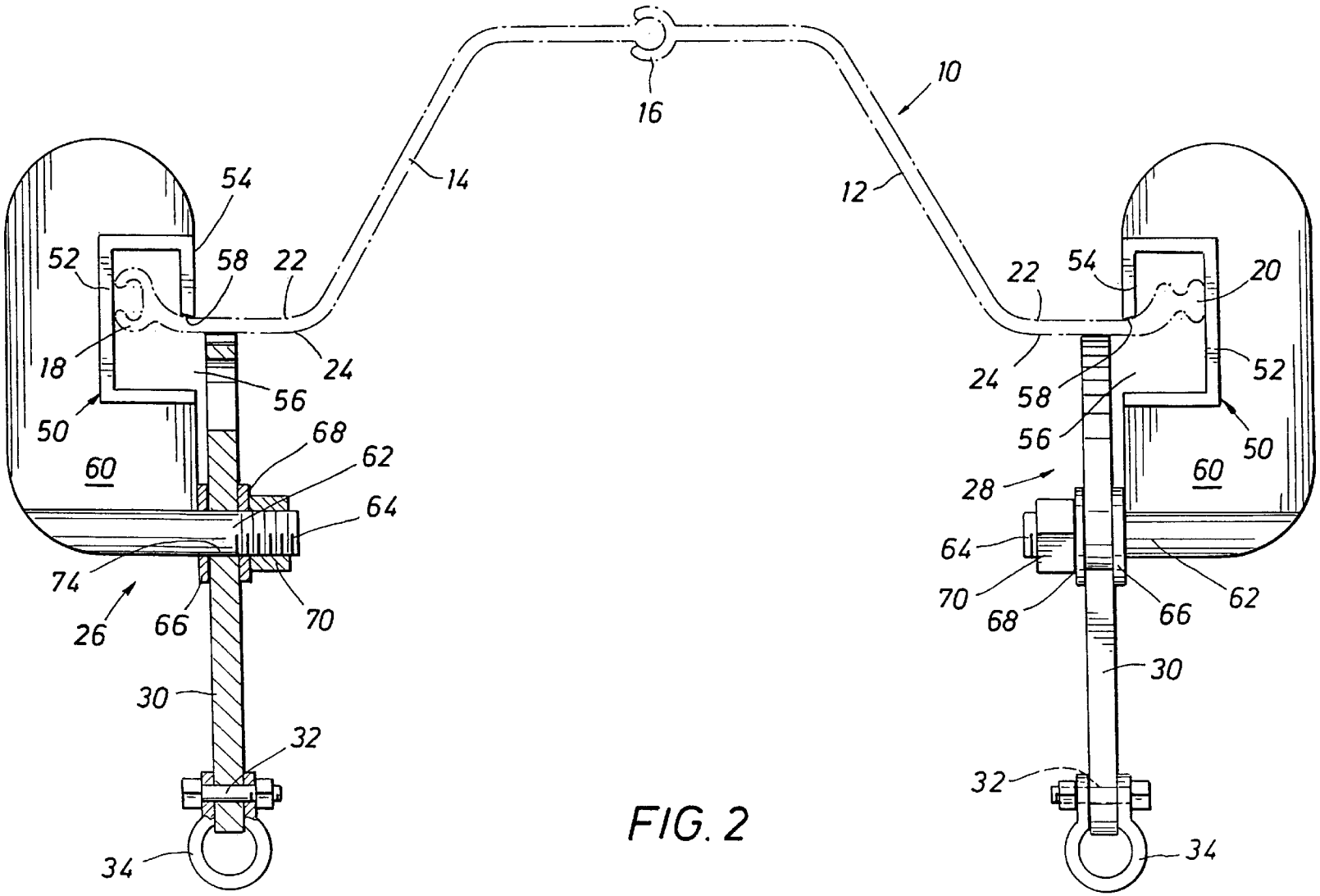
FIG. 2 is a top plan, partly schematic, of the lifting apparatus shown in FIG. 1.
Figure 3:
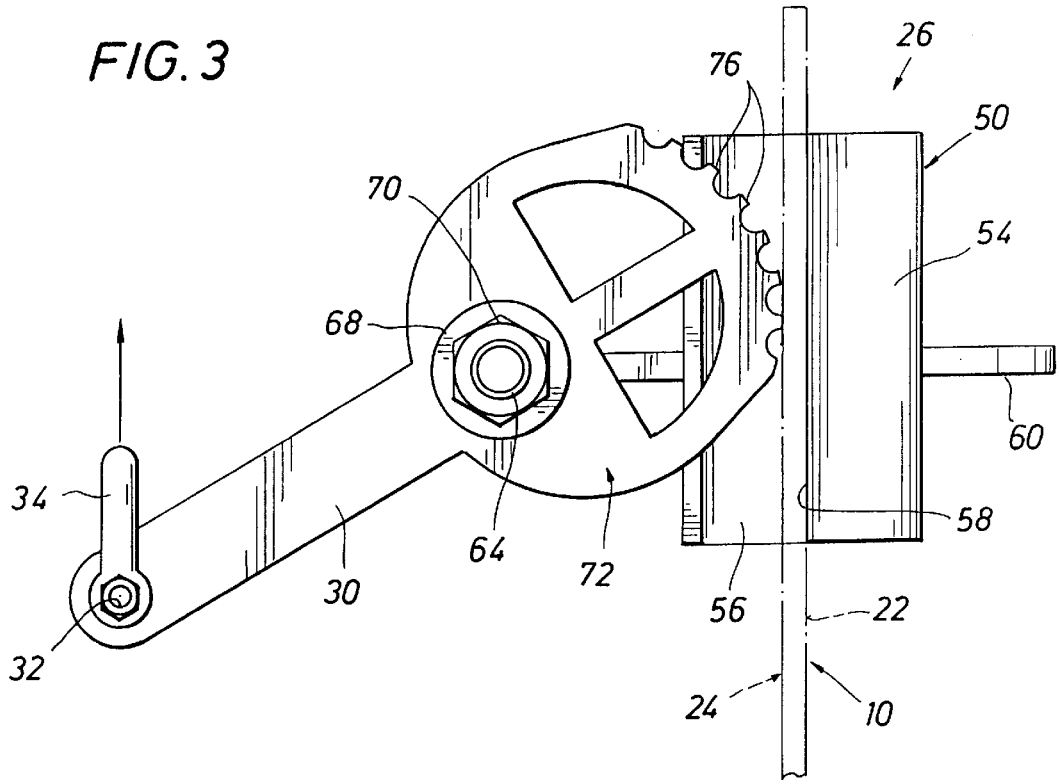
FIG. 3 is an enlarged side elevational view of a pile gripping device of the lifting apparatus shown in FIGS. 1 and 2 with the gripping device shown in a final gripping relation with the pile.
Figure 4:
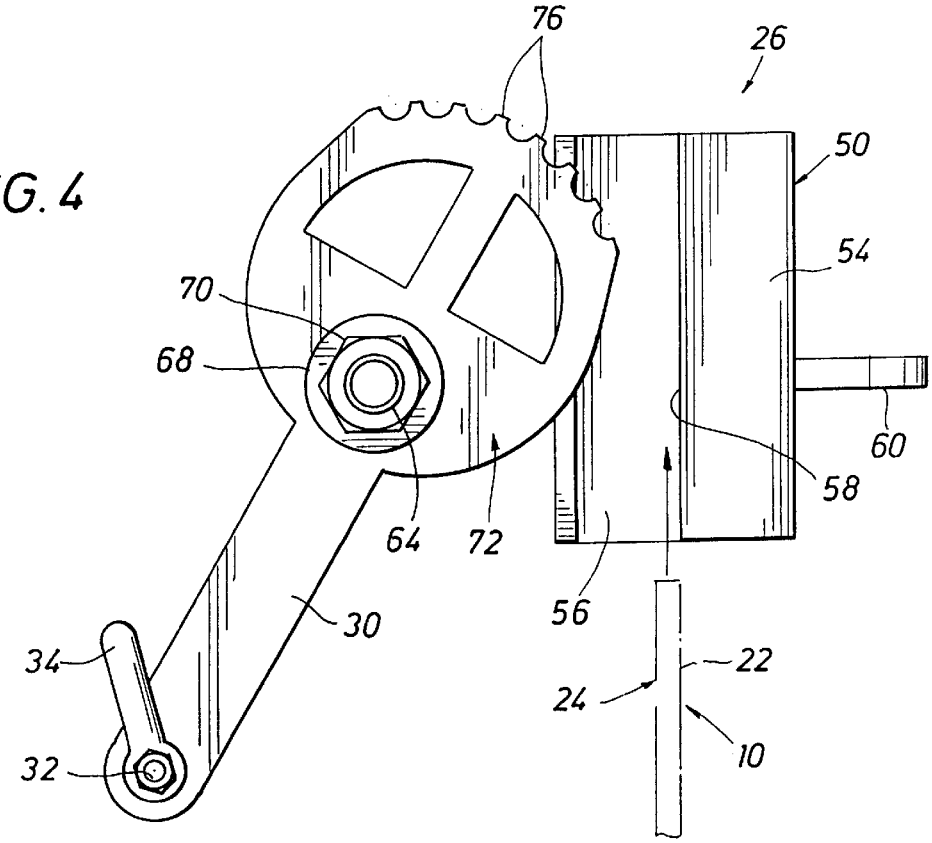
FIG. 4 is an enlarged side elevational view of the pile gripping device shown in FIG. 3 but showing the pile gripping device prior to being cammed into gripping relation with the sheet pile.

Referring to the drawings and particularly to FIGS. 1 and 2, a lifting apparatus for sheet piling which comprise the present invention is shown. An undriven sheet pile shown generally at 10 is illustrated as including a pair of Z-shaped pile sections 12 and 14 secured to each other at a tongue and groove connection 16. Pile 10 has a female groove 18 along one side and a male tongue 20 along the other opposed side. Undriven sheet pile 10 is lifted by an overhead crane, for example, to a height above an adjacent driven pile and male tongue 20 is then threaded or aligned vertically with a female groove in the driven pile. Then, sheet pile 10 is lowered to a surface level for being driven into the formation alongside the adjacent driven pile. The outer face of pile 10 is shown at 22 and the inner face of pile 10 is shown at 24. For further details of threading an undriven pile with a driven pile, reference is made to U.S. Pat. No. 5,618,135 dated Apr. 8, 1997, the entire disclosure of which is incorporated herein for all purposes.

A lifting apparatus includes a pair of lifting devices shown generally at 26 and 28. Lifting devices 26 and 28 are generally identical except adapted for mounting on opposite sides of sheet pile 10. Each lifting device 26 and 28 has a handle 30 with an opening or hole 32 therethrough. A clevis 34 is mounted on each handle 30 and a sling generally indicated at 36 has an upper eye or ring 38 receiving a hook 40 on the end of a chain or cable 42 extending downwardly from an overhead crane 44 for lifting of lifting devices 26 and 28. Sling 36 includes flexible members 46 connected by a rigid bar 48.

Lifting device 26 has a generally box-shaped open ended receptacle 50 having a back side 52 and a front side 54. A portion of front side 54 is cutaway to form a slot 56 and a backing edge 58. A base plate 60 is secured to receptacle 50 and has a shaft or axle 62 extending therefrom adjacent slot 56. Shaft 62 has a threaded outer end 64 and a pair of spaced washers 66, 68. An outer nut 70 may be threaded onto shaft 62. Washer 66 is fixed to shaft 62 and washer 68 along with outer nut 70 are removable from shaft 62.

A cam is shown at 72 having a lifting handle or lifting arrn 30 secured thereto and an opening 74 to receive shaft 62. Cam 72 has a plurality of teeth 76 about a portion of the outer periphery of cam 72 for contacting pile 10. For handling piles of different thicknesses, opening 74 may be positioned on cam 72 at a different location. Thus, different cams may be provided for different thicknesses of piles. Also, it may be desirable in some instances to provide a smooth cam without teeth.

The lifting apparatus of the present invention may be utilized for a single Z-shaped pile or a pair of Z-shaped pile sections 12 and 14 secured to each other as shown by pile 10. Lifting devices 26 and 28 may be utilized for lifting a single Z-shaped pile section or lifting a pair of Z-shaped pile sections.

As shown in FIGS. 1 and 2, female groove 18 of Z-shaped pile section 14 is inserted through slot 56 within receptacle 26 with groove 18 adjacent back side 52. The outer surface 22 of Z-shaped pile section 14 is placed in contact with backing edge 58. Next, male tongue 20 of Z-shaped section 12 is positioned within receptacle 50 of lifting device 28 with the front face or surface 22 engaging backing edge 58. Sling 36 in this position is in a slack position without any lifting force exerted against lifting handle 30. When pile 10 is properly positioned within lifting devices 26 and 28, an upward lifting force for sling 36 is applied by crane 44 to raise handles 30 and rotate cams 72 into gripping engagement with back face 24 of sheet pile 10. The lifting force exerted by cams 74 forces front face 22 into tight abutting contact with backing edge 58 with teeth 76 tightly gripping rear surface 24 of pile 10 adjacent backing edges 58 thereby tightly gripping pile 10 between opposed faces 22, 24. The greater the lifting force, the greater the gripping force exerted against the opposed faces 22, 24 of pile 10. Such a lifting apparatus has been found to be particularly useful in the raising or lifting of non-metallic piles, particularly piles formed of a vinyl material and without any damage or harm to the pile.

Figure 5:
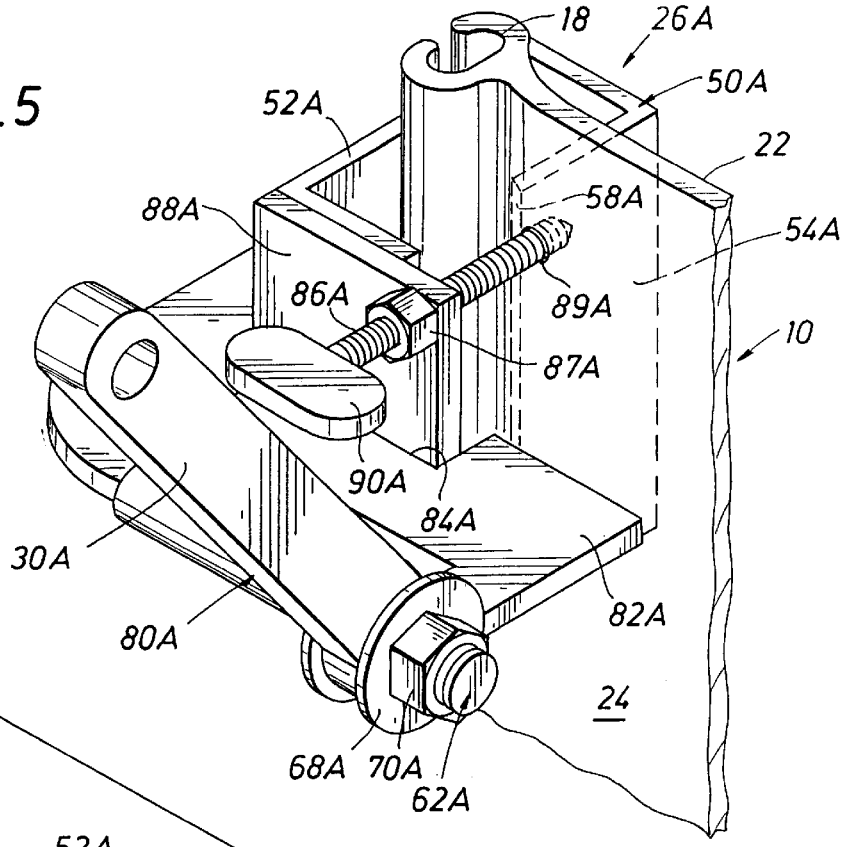
FIG. 5 is a perspective of a modified lifting device in which an adjustable pin is received within an opening of the sheet pile.
Figure 6:
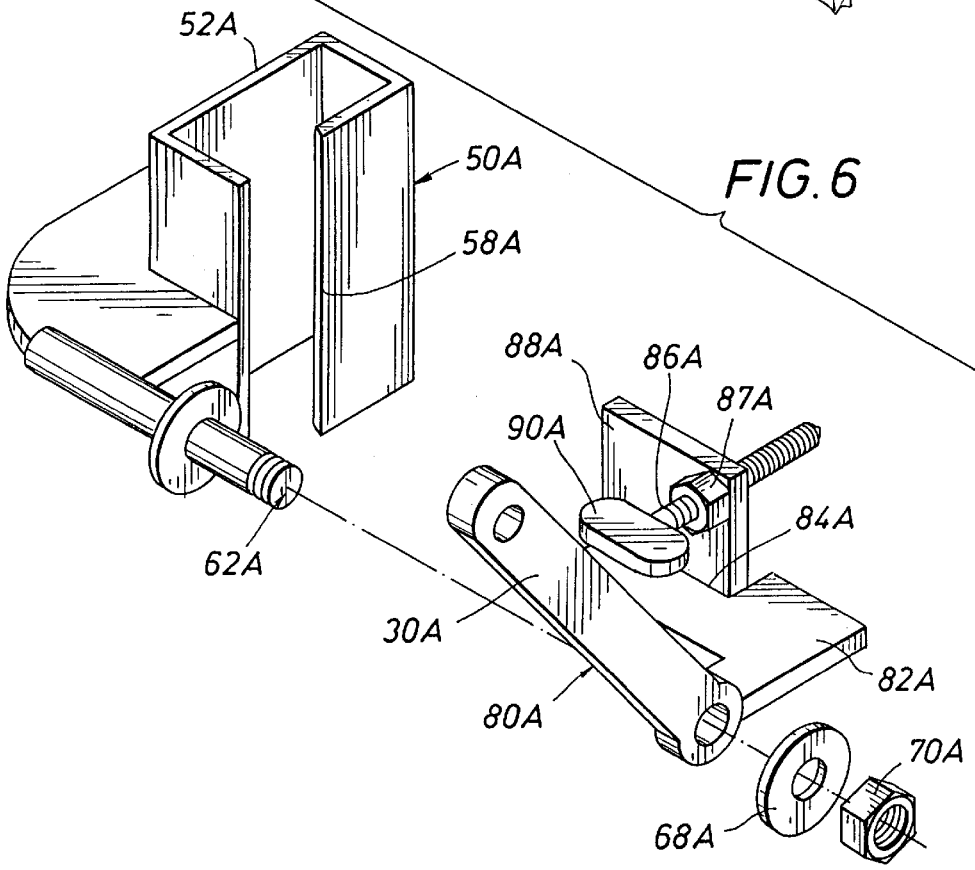
FIG. 6 is an exploded view of the modified lifting device shown in FIG. 5.

Referring to FIGS. 5 and 6, a modified lifting device is shown at 26A for receptacle 50A having a front side 54A defining a backing edge 58A. A back side 52A is provided. Lifting device 26A does not include a camming arrangement but includes an attachment indicated at 80A. Attachment 80A has a handle 30A which is mounted on shaft 62A and secured by nut 70A and washer 68A on shaft 62A. Handle 30A is fixed and does not rotate on shaft 62A. Splines may be provided on handle 30A and shaft 62A to restrict rotation, if desired. A base plate 82A is adapted to fit against rear face 24 of pile 10 with front face 22 of pile 10 fitting against backing edge 58A. A slot 84A is provided in plate 82A to receive side groove 18 of pile 10. For securing pile 10, a threaded securing screw shown at 86A having a lock nut 87A is mounted for threaded movement within an internally threaded plate 88A which is secured to receptacle 50A. Manual rotation of threaded screw 86A by manually operated handle 90A is effective to move threaded screw 86A within a receiving opening 89A in pile 10 with groove 18 received within receptacle 50A for securement of screw 86A by lock nut 87A. In this position, lifting device 26A is positively secured to pile 10. When pile 10 is lifted to the desired position and threaded within the driven pile for lowering onto a formation adjacent the driven pile, threaded screw 86A is removed from the opening in pile 10 thereby to permit removal of lifting device 26A. While an opening 89A is shown in pile 10 in the embodiment of FIG. 5, opening 89A may be eliminated in some instances with screw 86A tightened against the adjacent face of pile 10 to grip pile 10 against backing edge 58A.

From the foregoing, it is apparent that a lifting apparatus for non-metallic or lightweight piles has been provided which is effective to raise or lift an undriven pile to a desired position for threading within a driven pile, and then lowering the undriven pile onto the formation for being driven into the formation without any damage or injury to the piles. In one embodiment, the tight gripping action from a pair of lifting devices is effective for tightly gripping of the opposed faces of the pile with the gripping force being proportional to the total lifting force. Such a lifting apparatus has been found to highly effective.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A lifting device for lifting an undriven sheet pile having a marginal side edge portion for interfitting an adjacent marginal side edge portion of a driven pile comprising:

a base;

a box-like receiver adjacent said base having opposed open ends and receiving said marginal side edge portion of the undriven sheet pile, said receiver having a side edge in abutting contact with one face of the undriven sheet pile;

a pile support member on said base for contacting the opposed face of said undriven sheet pile; and a lifting handle on said pile support member for attachment to an overhead lifting means for raising of said undriven pile to a predetermined height resulting from a lifting force from said overhead lifting means.

2. A lifting device as set forth in claim 1 wherein said pile support member includes a threaded bolt for securing said sheet pile and a lower plate member below said threaded bolt for contacting said opposite face of said undriven pile.

3. A lifting device as set forth in claim 1 wherein said pile support member includes a cam member, and means mount said cam member for pivotal movement into gripping contact with an opposed face of the undriven pile.

4. Lifting apparatus for lifting an undriven sheet pile having a pair of opposed side edge portions for interlocking with adjacent sheet piles, said lifting apparatus comprising:

a pair of spaced lifting devices for said undriven sheet pile, one lifting device fitting about one side edge portion and the other lifting device fitting about the other opposed side edge portion for gripping of said side edge portions;

a handle for each of said lifting devices;

a flexible lifting sling connected to each of said handles; and an overhead lifting means connected to said lifting sling for lifting of said sling and said undriven sheet pile supported thereby upon gripping of said side edge portions by said lifting devices.

5. Lifting apparatus as set forth in claim 4 wherein each lifting device includes a cam operatively connected to an associated handle so that upward movement of the handles effects a camming action against an adjacent face of the sheet pile for gripping of the sheet pile by the cams adjacent said opposed side edge portions of the sheet pile.

* * * * *